United States Patent [19]

Osborne

[11] 4,333,094

[45] Jun. 1, 1982

[54] SWIMMING POOL ALARM

[75] Inventor: William E. Osborne, Whittier, Calif.

[73] Assignee: Homexx International Corp., Anaheim, Calif.

[21] Appl. No.: 163,314

[22] Filed: Jun. 26, 1980

Related U.S. Application Data

[63] Continuation-in-part of Ser. No. 966,382, Dec. 4, 1978, abandoned.

[51] Int. Cl.[3] ..... G08B 21/00

[52] U.S. Cl. ..... 340/566; 200/61.47; 200/233; 200/DIG. 8; 312/100; 340/565; 340/693

[58] Field of Search ..... 340/566, 565, 573, 693, 340/542, 65, 63; 200/61.47, DIG. 8, 233; 312/100, 284, 352

[56] References Cited

U.S. PATENT DOCUMENTS

| | | | |
|---|---|---|---|
| 1,729,485 | 9/1929 | Long | 200/233 |
| 2,207,406 | 7/1940 | Jones | 200/61.47 |
| 3,054,096 | 9/1962 | Peritz | 340/566 |
| 3,276,006 | 9/1966 | White | 340/566 |
| 3,289,194 | 11/1966 | King | 340/693 |
| 3,626,403 | 12/1971 | Ive | 340/693 |
| 3,757,318 | 9/1973 | Brisson | 340/565 |
| 3,786,469 | 1/1974 | Massaro et al. | 340/566 |
| 3,786,472 | 1/1974 | Scopacasa | 200/61.47 |
| 3,919,629 | 11/1975 | Scruggs | 307/252 R |
| 3,953,843 | 4/1976 | Codina | 340/566 |
| 4,006,450 | 2/1977 | Ofenleger | 340/63 |
| 4,203,097 | 5/1980 | Manning | 340/566 |

*Primary Examiner*—Glen R. Swann, III

*Attorney, Agent, or Firm*—Paul A. Weilein

[57] ABSTRACT

A free-floating self-contained swimming pool alarm unit in which a hollow housing forms a float structure having an internal chamber within which an audible alarm device is mounted adjacent sound transmitting openings in a top wall of the housing. An upstanding flared chimney surrounds the openings and provides a sound amplifying horn, the outer end of the chimney being provided with a shielding cap. Electronic control is arranged to trigger and activate the alarm device by connecting it to an electric source in the housing in response to the operation of a liquid sensor switch as a result of tilting movements of the housing due to wave disturbances produced by an object or person falling into the pool. Once the alarm is triggered, it will continue to operate until deactivated by an appropriate switch such as a manual switch mounted in an accessible portion of the housing.

9 Claims, 5 Drawing Figures

SWIMMING POOL ALARM

CROSS REFERENCE TO RELATED APPLICATION

This application is a continuation-in-part of my application entitled SWIMMING POOL ALARM, Ser. No. 966,382, filed Dec. 4, 1978, now abandoned.

PRIOR ART

In the prior art there are a variety of alarm arrangements for swimming pools and the like which are controlled by sensor switches such as a pendulum switch, pressure switch, or other means adapted to close a control circuit in response to the agitation of the water in the pool. The closest art known to applicant are the following U.S. Pat. Nos.:

3,036,296: May 22, 1962.
3,054,096: Sept. 11, 1962.
3,276,007: Sept. 27, 1966.
3,732,556: May 8, 1973.
3,760,396: Sept. 18, 1973.
3,786,469: Jan. 15, 1974.

BACKGROUND OF THE INVENTION

The present invention relates generally to warning devices.

It has heretofore been generally known to provide a variety of emergency alarm devices for swimming pools and other restricted bodies of water, in which a float-supported tilt switch is operable to set off an electrically activated alarm device such as a buzzer, bell, siren or other type of audible alarm.

The known devices range from very simple float alarms to more complex and sophisticated alarm arrangements which differ primarily as to their alarm control circuitry.

U.S. Pat. No. 3,276,007 is exemplary of the known simple alarm arrangements, and discloses a float-carried alarm device which is directly connected with a battery energizing circuit containing a mercury switch that is adapted to open and close the energizing circuit in response to tilting movements of the float due to agitation of the water surface by an entering object or person. While such simple alarms were economical to produce, their operation was intermittent and spasmodic due to the opening and closing of the sensor switch rather than producing a continuous alarm once the switch closed and energizing circuit.

Later known developments are exemplified by U.S. Pat. No. 3,732,556 which discloses an alarm control circuit that overcomes the problem of intermittent operation as just described for the simple type of circuit and employs means for locking in the alarm circuit once the alarm has been activated, and in this manner produces a loud and continuous alarm which is less likely to go undetected. For such purpose, the control circuit of this patent utilizes the sensing switch means in the gate circuit of an SCR (silicon controlled rectifier) which operates to activate an energizing circuit of the alarm device, and once having operated locks in until a reset switch is activated.

The present invention proposes to provide a pool alarm having an improved electronic control circuit in which the sensor switch is utilized to control a transistor trigger circuit connected with the SCR gate to obtain (1) greater stability, (2) increased protection for the sensitive gate of the SCR, and (3) means whereby the sensitivity of the alarm unit may be adjustably controlled.

SUMMARY OF THE INVENTION

More specifically, the present invention relates to an improved warning alarm device for swimming pools and other restricted bodies of water.

Having in mind the problems and inherent disadvantages of the prior art devices, it is an object of the present invention to provide an improved and unique pool alarm which is controlled by a control circuit in which a liquid activated sensor switch controls a triggering transistor in the gating circit of electronic switching means for activating an audible alarm device in response to surface disturbances caused by an entering object or person.

A further object resides in the provision of a self-contained free-floating pool alarm unit in which the electronic control components and the alarm device are contained in a float housing of unique construction which includes a sound amplifying horn portion in operative association with the alarm device.

Another object is to provide in a pool alarm an electronic control circuit for an electrically activated audible alarm device, which includes triggering control means connected to respond to a water activated switch of unique construction.

Still another object is to provide a pool alarm according to the previous object, in which the sensor switch is adjustable to vary its sensitivity.

Further objects and advantages of the invention will be brought out in the following part of the specification, wherein detailed description is for the purpose of fully disclosing several embodiments of the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENTS

Figure 1:
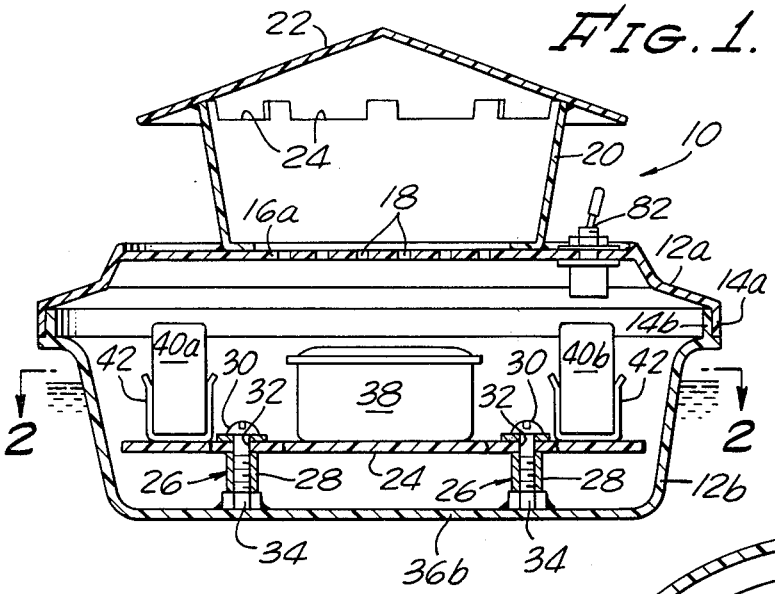
FIG. 1 is a vertical sectional view taken through the float housing of an alarm unit embodying the features of the present invention.

Referring more specifically to the drawings, for illustrative purposes, the invention is shown in FIG. 1 as being embodied in a float, as generally indicated at 10, which is fabricated preferably of a suitable plastic material to provide a generally hollow housing adapted to receive the alarm components therein.

The housing is comprised of a top section **12*a* and a bottom section 12*b*, these sections being of concave configuration and assembled in confronting relation with their peripheries sealingly joined by interfitting flanges 14***a* and 14*b*. The top section 12*a* has a top wall 16*a* which contains a generally central area having a plurality of openings 18 for the transmission of sound waves from the interior of the housing to the exterior thereof.

An upstanding chimney 20 is affixed at its lower end to the top wall 16*a* as by bonding or other suitable means in surrounding relation to the openings 18, and at its upper end is affixed to a conical cap member 22 which has its peripheral margin extending radially outwardly beyond the upper end of the chimney 20. The chimney 20 is upwardly flared to form in effect an amplifying horn for the sound waves which emanate through the openings 18. As will be seen in FIG. 1, the upper end of the chimney 20 is provided with circumferentially spaced cutouts 24 which provide communicating openings for the interior of the chimney to the exterior thereof. As thus arranged, the cap member 22 provides a protective shield for the underlying openings 18 against the entrance of spray from the pool surface, rain and the like.

A circular platform 24 of fiberglass or other suitable material is mounted in the bottom section 12*b* of the housing to provide a chassis board for the mounting of the various components of the alarm unit. As shown, the platform 24 is supported in an elevated position by a plurality of post structures, as generally indicated by the numeral 26. Each post structure comprises a spacer sleeve 28 which surrounds a retaining screw positioned in an opening 32 in the platform 24, this screw having its threaded end portion engaged with a nut 34 bonded or otherwise secured to the inner surface of a bottom wall 36*b* of the housing bottom section 12*b*. Alternatively, spacer sleeve 28 may be eliminated, and the screw engaged with a female threaded post mounted in the plastic or other material of the housing bottom section 36*b*.

Figure 2:
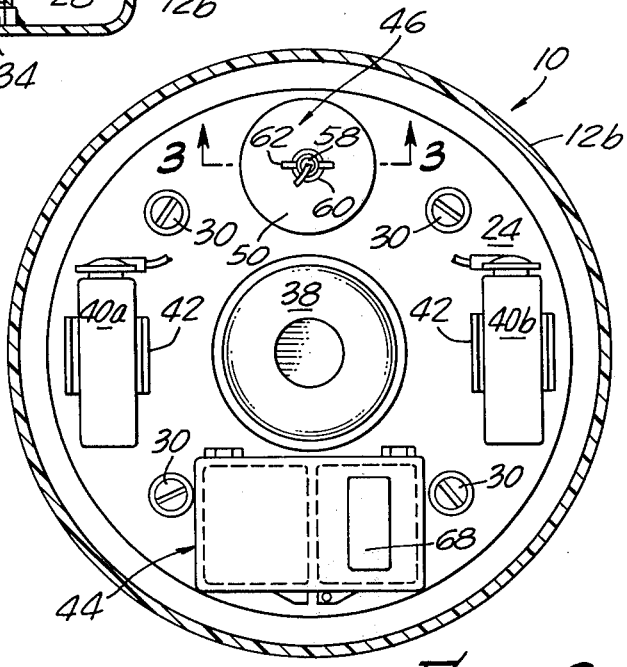
FIG. 2 is a transverse sectional view, taken substantially on line 2—2 of FIG. 1, and showing the disposition of the various components within the housing.

As best seen in FIGS. 1 and 2, the components of the alarm unit, which are mounted on the platform 24, comprise an audible alarm device 38 which is positioned centrally in the housing directly below the openings 18 so that the sound waves therefrom may be readily transmitted through the openings 18 for amplification in the chimney structure. Nine-volt batteries 40*a* and 40*b* are respectively supported in clips 42 diametrically positioned on opposite sides of the alarm device 38. In diametric relation at right angles to the batteries, there is provided a container 44 for the components of the electronic control circuitry, and a water activated sensor switch 46.

Figure 3:
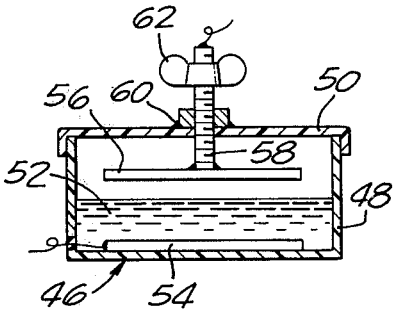
FIG. 3 is an enlarged vertical section taken through the water activated sensor as utilized in the alarm control circuitry, taken substantially on line 3—3 of FIG. 2.

The water activated sensor switch 46, as shown in FIG. 3, comprises a cup-shaped container 48 of a suitable plastic and a top closure cover 50, which is adapted to contain a very small quantity of water 52 which is shown as substantially halfway filling the container. For such purpose, ordinary tap water has been found to contain a sufficient amount of salts and other impurities to give the water a low order of conductivity. The bottom of the container supports a submerged fixed contact member 54, and an adjustable contact member 56 is positioned above the water surface. The contact member 56 is carried by a threaded central stem 58 which extends through and has threaded engagement with a nut 60 bonded or otherwise affixed to the upper surface of the cover 50. The projecting upper end of the stem 58 carries a fixedly mounted wing nut 62 which is manually operable to turn the threaded stem 58 so as to variably position the contact 56 with respect to the surface of the water. In this manner, the sensitivity of the sensor may be suitably varied. The stem 58 also provides a terminal connection for the contact 56.

Figure 4:
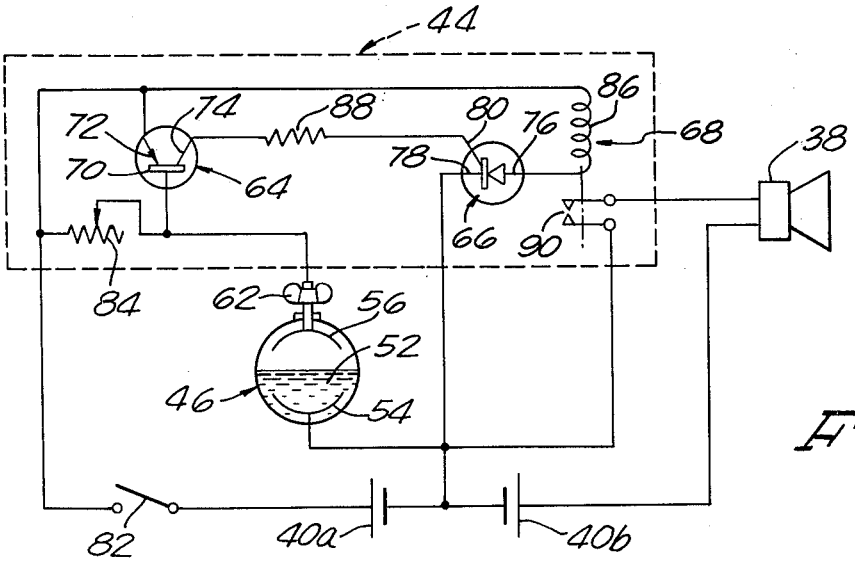
FIG. 4 is a schematic wiring diagram of the control circuitry as utilized in the alarm unit of the present invention.

Referring to the schematic wiring diagram in FIG. 4, it will be seen that the container 44 houses a triggering transistor 64, an SCR 66 and a sub-miniature relay 68 together with the operating interconnections and control resistors. The transistor 64 is shown as a PNP type. However, it is well known in the art that an NPN type transistor may be utilized by simply reversing the polarities. The transistor is of conventional construction containing a base 70, an emitter 72 and collector 74. The SCR contains the conventional anode 76, cathode 78 and gate 80. The two nine-volt batteries 40*a* and 40*b* are shown as being interconnected so that one of the batteries serves to provide the energy for controlling the operations of the transistor 64 and SCR 66 which require relatively low current drain, while the other battery is in the control circuit of the alarm device 38, and thus requires a greater current drain. With this arrangement, it is only necessary to occasionally replace the battery that is subject to such high drain.

The water activated sensor switch 46 is shown as being connected between the base side of the input circuit of transistor 64 and a negative side of battery 40*a*, while the emitter side of the input circuit of this transistor is connected to the positive side of the battery 40*a* through a manually operable reset switch 82, which for convenience of operation is disclosed in FIG. 1 as being mounted on the top wall 16*a* outwardly of the chimney 20. A stabilizing resistor of 5 or 10K in the form of a potentiometer 84 is connected between the emitter 72 and a base 70 of the transistor 64, and provides means for variably adjusting the operating sensitivity of the transistor 64 in a manner to produce an output signal in its output circuit as defined by the transistor base 70 and collector 74, in response to the closing of the contacts in the water activated sensor switch 46.

The cathode 78 of the SCR 66 is connected to the negative sides of the batteries 40*a* and 40*b* which are connected in back-to-back relation. The anode 76 of the SCR is connected through an actuating coil 86 of the relay 68 to the positive side of the battery 40*a* which is connected to the emitter 72 of the transistor 64. The gate 80 of the SCR is connected to the collector 74 of the transistor 64 through a protective resistor 88 of substantially 4.7K ohms. Upon energization of the actuating coil 86 of the relay, the relay will close its contacts 90 to connect the energizing circuit of the alarm device 38 to the positive side of the other battery 40*b*. It will be appreciated that the contacts 90 may, if desired, be placed in the positive connection of the alarm device to the battery 40*b*. When the transistor 64 is activated to trigger the SCR 66, the energizing circuit of the alarm device 38 will be locked in and remain energized until the switch 82 is manually operated. While a manually operable switch 82 has been disclosed for resetting the SCR, it will be appreciated that automatic means may be provided for effecting the operation of a relay switch, if desired.

In the operation of the above described arrangement, it will be apparent that, when the sensor switch 46 is tilted by a pool disturbance, interconnection of its contacts 54 and 56 by the water therein will operate to place a water resistance of approximately 6000 ohms across the base of the transistor 64, which is at cut-off in its idling mode, and thereby apply a forward voltage of negative polarity. With the base thus suddenly forward-biased, a surge of current triggers the gate of the SCR which now operates to energize the relay 68 which will close its contacts 90 and thereby energize the alarm device 38. Due to the operating characteristics of the SCR, the alarm device will continue to operate until the reset switch 82 is opened.

Figure 5:
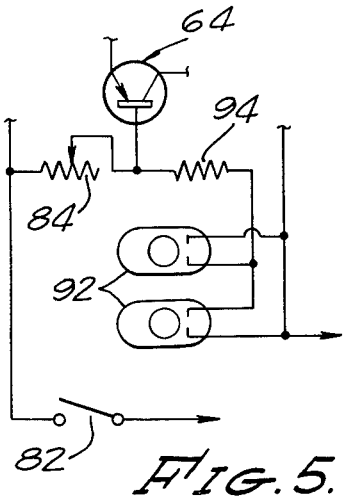
FIG. 5 is a fragmentary diagram of a portion of the circuitry, showing the use of mercury activated sensor switches.

As shown in FIG. 5, an equivalent circuit arrangement to that of the water activated sensor switch 46 may be utilized. In this case, a pair of parallel connected mercury switches 92 are connected in series with a resistor 94 of substantially 5K ohms.

From the foregoing description and drawings, it will be clearly evident that the delineated objects and features of the invention will be accomplished.

Various modifications may suggest themselves to those skilled in the art without departing from the spirit of the disclosed invention and, hence, it is not wished to be restricted to the specific forms shown or uses mentioned, except to the extent indicated in the appended claims.

I claim:

1. A free-floating housing for use with a swimming pool alarm device, comprising:

a housing formed by top and bottom concave sections peripherally interconnected in confronting relation to provide an internal chamber;

a plurality of openings formed in a central area portion of said top section;

an upstanding cylindrical chimney surrounding said openings; and a shielding cap secured to the upper end of said chimney.

2. A housing according to claim 1, in which:

said chimney is longitudinally flared from its lower end to its upper end.

3. A housing according to claim 1, in which:

said cap is of conical configuration and has a peripheral margin extending outwardly beyond the periphery of the adjacent end of the chimney.

4. A housing according to claim 1, in which:

the upper end of said chimney is formed with circumferentially spaced end edge cutout portions to provide communicating passages between the interior and exterior of the chimney.

5. A housing according to claim 1, in which:

said top and bottom sections are formed with slip fitting peripheral flanges.

6. A housing according to claim 1, which includes:

a platform within said chamber; and post means for supporting said platform in an elevated position comprising:

a plurality of sleeve members; and threaded retaining members respectively extending through the platform and sleeve members and threadedly engaged with nuts affixed to a bottom wall of the bottom section of the housing.

7. A housing according to claim 1, which includes:

a platform within said chamber; and post means for supporting said platform in an elevated position, comprising:

a plurality of spacers respectively including an internally threaded member affixed to a bottom wall of the bottom section of the housing; and retaining screws respectively extending through the platform and having threaded engagement with the threads of said affixed member.

8. A swimming pool alarm, comprising:

(a) a hollow float adapted to float on the pool surface, comprising:

a two-part housing composed of a bottom section and a top section having a peripherally sealed connection, and coacting to provide an internal compartment;

a chassis board supported in an elevated position above a bottom wall of said bottom section and providing a mounting panel;

said top section being provided with a plurality of sound transmitting openings;

and means on said top section providing a protective shield over said sound transmitting openings, wherein the protective shield means comprises:

an upstanding chimney peripherally surrounding said sound openings, and said chimney at its upper end mounts a shielding cap;

(b) means within said float on said mounting panel for generating a control signal in response to the tilting movements of the float including:

a trigger circuit including a transistor having an input and output;

sensor means connected to said input and being operable in response to the tilting movements of the float to trigger said transistor and produce a control signal at said output; and (c) alarm control means on said mounting panel including:

a control circuit including a silicon controlled rectifier having a gating connection coupled to receive said control signal from said output, and upon actuation by said control signal being operative to energize said control circuit; and an alarm device of the audible type on said mounting panel activated in response to the energization of said control circuit.

9. A pool alarm according to claim 8, in which:

said chimney and shielding cap coact to define a plurality of communicating openings between the interior and exterior of said chimney.

* * * * *